US005339963A

United States Patent [19]

Tao

[11] Patent Number: 5,339,963

[45] Date of Patent: Aug. 23, 1994

[54] METHOD AND APPARATUS FOR SORTING OBJECTS BY COLOR

[75] Inventor: Yang Tao, Woodstock, Va.

[73] Assignee: Agri-Tech, Incorporated, Woodstock, Va.

[21] Appl. No.: 846,236

[22] Filed: Mar. 6, 1992

[51] Int. Cl.[5] ..... B07C 5/342

[52] U.S. Cl. ..... 209/581; 209/587; 209/939; 356/406; 364/526

[58] Field of Search ..... 209/580, 581, 582, 587, 209/701, 939; 356/402, 406, 407; 364/326

[56] References Cited

U.S. PATENT DOCUMENTS

| | | | |
|---|---|---|---|
| Re. 29,031 | 11/1976 | Irving et al. . | |
| 2,881,919 | 4/1959 | Bartlett . | |
| 3,066,797 | 12/1962 | Fraenkel . | |
| 3,770,111 | 11/1973 | Greenwood et al. . | |
| 3,993,899 | 11/1976 | Chapman . | |
| 4,057,146 | 11/1977 | Castaneda et al. . | |
| 4,120,402 | 10/1978 | Swanson | 209/580 X |
| 4,131,540 | 12/1978 | Husome et al. | 209/582 |
| 4,132,314 | 1/1979 | Von Beckmann et al. . | |
| 4,204,950 | 5/1980 | Burford, Jr. | 209/582 X |
| 4,205,752 | 6/1980 | Malvick et al. | 356/407 X |
| 4,246,098 | 1/1981 | Conway et al. | 209/587 X |
| 4,278,538 | 7/1981 | Lawrence | 209/581 X |
| 4,334,782 | 6/1982 | Thornton, Jr. et al. | 356/406 |
| 4,454,029 | 6/1984 | Codding | 209/581 |
| 4,470,702 | 9/1984 | Matsumoto et al. | 356/406 X |
| 4,476,982 | 10/1984 | Paddock et al. | 209/582 |
| 4,515,275 | 5/1985 | Mills et al. | 209/580 X |
| 4,726,898 | 2/1998 | Mills et al. | 209/587 X |
| 4,834,541 | 5/1989 | Yamaba | 356/406 |
| 5,078,258 | 1/1992 | Vander Schoot | 209/581 X |
| 5,085,325 | 2/1992 | Jones et al. | 209/580 |
| 5,156,278 | 10/1992 | Aaron et al. | 209/587 X |
| 5,159,185 | 10/1992 | Lehr | 356/406 X |

OTHER PUBLICATIONS

Thomason, "High Speed Machine Vision Inspection for Surface Flaws, Textures and Contours", Vision '86 Conference Proceedings, Jun. 3-5, 1986.

Miller, "Automated Inspection/Classification of Fruits and Vegetables", Transactions of the 1987 Citrus Engineering Conference, Mar. 26, 1987, vol. XXXIII.

Tao et al, "Automated Machine Vision Inspection of Potatoes", ASAE Paper #903531, Jan. 1990.

Vartec Corporation, "New Product Announcement Megaspector", Aug. 1988.

Sony, "1CCD R.G.B. Primary Color Filter Camera Module XC-711/711P". (No Date Given).

*Primary Examiner*—D. Glenn Dayoan

*Attorney, Agent, or Firm*—Foley & Lardner

[57] ABSTRACT

A color sorting apparatus has a singulator section, a color sorter and a conveyor which drops the sorted objects into appropriate collection bins. Objects for sorting are transported on an endless conveyor on wheels through the singulation and color sorting section. An independently adjustable speed belt rotates in the same direction as the wheels and operates to provide a view of each of four sides of the object to an imaging device. The imaging device, such as a camera, supplies red, green and blue signals to an image processor which performs a color transformation and obtains a single composite hue value for each object or piece of fruit to be sorted. Based on a comparison of the hue value to user programmed grading criteria, signals are provided to the conveyor so that the objects are ultimately deposited in appropriate sorting bins.

8 Claims, 11 Drawing Sheets lane 1 =
time =
at $t_0$ =
at $t_1$ =
$t_2$ =
$t_3$ =

METHOD AND APPARATUS FOR SORTING OBJECTS BY COLOR

BACKGROUND OF THE INVENTION

Field of the Invention

The invention is related to an apparatus and method for sorting objects, in particular fruit, by color.

Related Art

Numerous attempts have been made to sort items, such as fruit, by color. U.S. Pat. No. 2,881,919 to Bartlett discloses the use of multiple photocells to determine the intensity of light measured from discrete and focused areas of a peach. U.S. Pat. Nos. 3,066,797, 4,454,029, and 3,993,899 disclose sorting machines which use fiber optics to sense different portions of an object and which use light sensors which sense different colors. U.S. Pat. No. 3,770,111 discloses an apple sorter which includes numerous fiber optic cables located around the circumference of an apple. The fiber optic cables are routed to two different color sensors. U.S. Pat. No. 29,031 discloses a circuit for sorting apples according to a ratio of colors. U.S. Pat. Nos. 4,057,146 and 4,132,314 disclose sorters which use fiber optic cables and a ratio of colors to sort fruit into two or several color categories. These sorters use photosensitive devices and do not compute the percentage of a certain color.

Vartec Corp. markets an optical inspection system known as Megaspector which uses an image processor implementing gray-scale processing methods. The Vartec processor inspects each individual item in the field of view and determines its acceptability based on user programmed inspection criteria. An article entitled High Speed Machine Vision Inspection for Surface Flaws Textures and Contours by Robert Thomason discloses a system employing an algorithm that processes neighborhood gray-scale values and vector values as implemented in circuit hardware in a distributed processing computer. Thomason discloses that in gray-scale and neighborhood processing techniques, each pixel has a numeric value (64 levels for 6-bit, 256 levels for 8-bit) which represents its gray-scale value. The neighborhood processing compares a pixel with its neighbors and filters out irrelevant information. This transforms each image into another image that highlights desired information. Using low pass filtering, signal to noise ratio can be improved, while high pass filtering enhances the edges of an image. Thomason further discloses a method in which the images are analyzed by high pass filtering to highlight edges and contours and by vector direction at each pixel in order to distinguish edge features from defects on the surface of an object. Pixels in the image are compared to a preprogrammed look-up table, which contains patterns associated with each type of feature.

Automated Inspection/Classification of Fruits and Vegetables by William Miller in The Transactions of the 1987 Citrus Engineering Conference discloses grading requirements and sensor techniques for various sorting approaches. FIG. 3 provides response curves for various optical detectors and FIG. 6 discloses general schematics for different sorting systems.

Automated machine Vision Inspection of Potatoes by Y. Tao, et al. published in 1990 discloses a machine vision system for inspecting potatoes by size, color, shape and blemishes. The system employed methods of using HSI (hue, saturation, and intensity) color scheme and multi-variant discriminate analysis for potato greening classification. Tao discloses a color transformation which reduces color evaluation for red, green and blue stored in three image buffers to one single hue buffer. Hue, H, is calculated by:

$$H=[90^\circ+\tan^{-1}([2R-G-B]/[\sqrt{3}(G-B)])+180^\circ \text{ if } G<B]]*255/360 \qquad \text{Eqn 1}$$

Tao further discloses that color feature extraction was achieved using a hue histogram which gathers color components and the amount of area of the color in an image. A blue background was used for best contrast between the potato and the background. Tao discloses that it was necessary to use a multi-variant discriminate method for potato classification, since it was difficult to determine a single effective threshold for greening determination. A linear discriminate function was also generated in which the primary procedure was to train the program by samples for the classification criteria and classify a new sample based on the criteria.

Other conventional approaches require obtaining a red-to--green ratio or a mixture of red, green and blue ratios. Clustering, red, green and blue variations, cut by color groups, and trend analysis for grading have also been employed.

Many of the above color sorters have been of limited use because they require the operator to identify percentages or other measures of individual colors for sorting purposes. Such methods introduce significant complexity and related errors. The method taught by Tao does not disclose a system which provides an operator the ability to establish separate grading criteria.

SUMMARY AND OBJECTS OF THE INVENTION

In view of the limitations of the related art, it is an object of the invention to provide a color sorting apparatus which sorts based on evaluating images of an entire surface of the fruit;

It is still another object of the invention to sort fruit based on color by obtaining a single hue value from red, green and blue components measured in the fruit;

It is a still further object of the invention to establish a continuous hue spectrum from red to green so that individual values on the spectrum can be selected by a user to differentiate grades of fruit by color;

It is still another object of the invention to compare hue values measured for individual pieces of fruit with the hue values selected on the continuous spectrum by an operator and grade the individual fruit items in accordance with the operator's selected grades.

These and other objects of the invention are accomplished by a color sorter which obtains a plurality of images, typically four images, showing various sides of an object as it is rotated in the field of view of an image acquisition device. The image acquisition device, typically a red-green-blue (RGB) camera, provides RGB signals for storage in memory. RGB signals for each image of the plurality of images of an object are transformed to the hue-saturation-intensity (HSI) domain by a processor. Of course, it is possible to implement the invention without storing the RGB values in memory by performing the transformation directly and storing only the HSI representation. A single hue value is obtained for each view of the object. This hue is based on the all the pixel hues for each view of the object. A composite hue value for the object is then obtained, for example by a summing or averaging technique. It would also be possible to obtain a composite RGB value and perform the transformation to obtain the composite hue value from the composite RGB. The composite hue value for an object is then compared to programmed grading criteria to divert objects to collections bins according to the sorting criteria. In addition, the hue value for each view can be further used to compare each view hue value to user-specified grades or categories to further separate objects in more detail. Moreover, the individual view pixels in a certain hue range, for example can be summed and compared to the total pixels to obtain a percentage of a certain hue range. This value can be used to further separate the objects.

BRIEF DESCRIPTION OF THE DRAWINGS

The above objects of the invention are accomplished by the apparatus and method described below with reference to the drawings in which.

Figure 8:
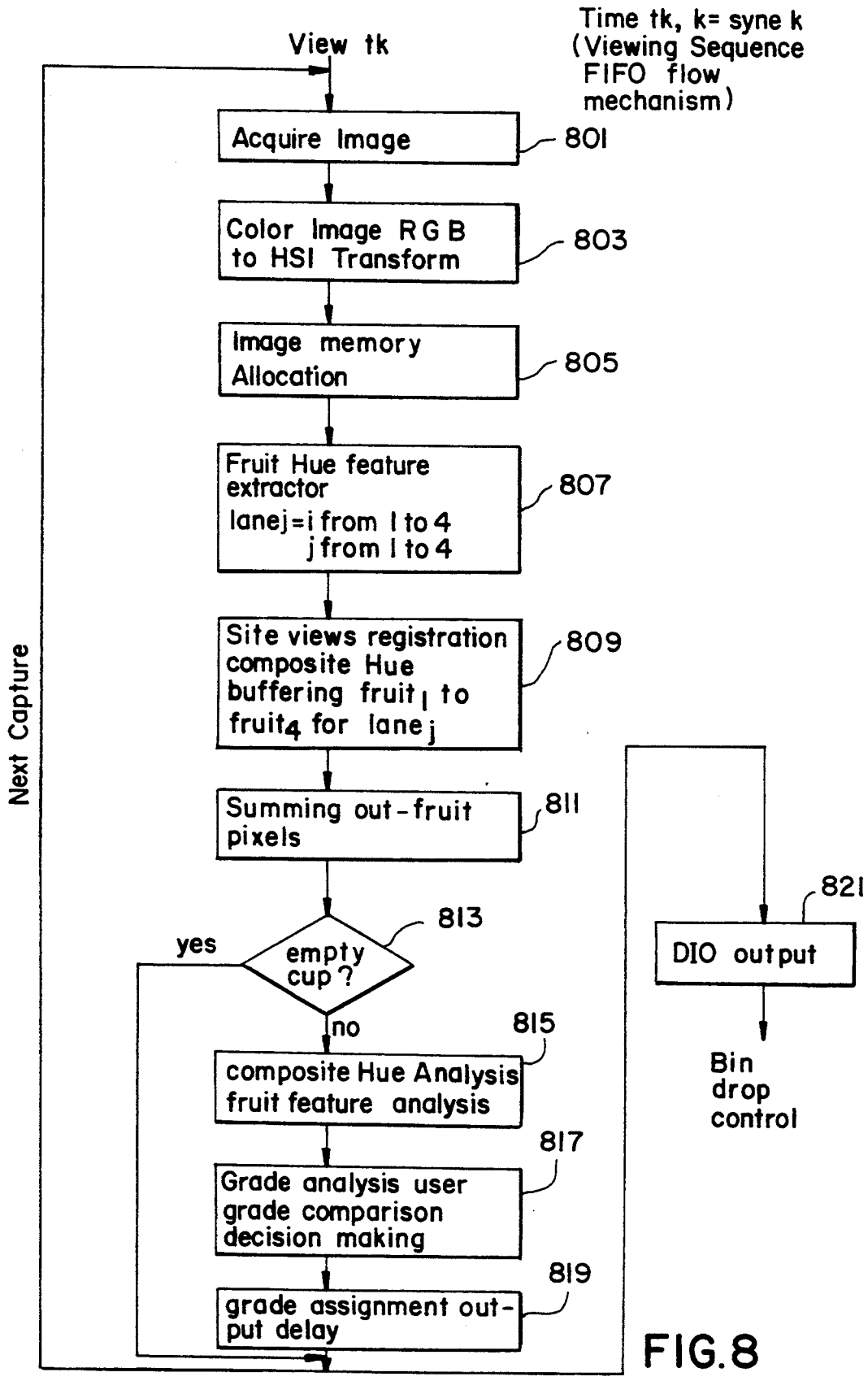
Figure 9A:
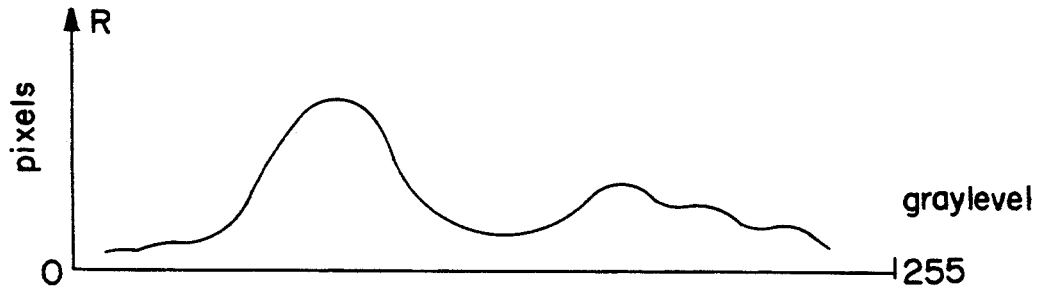
Figure 9B:
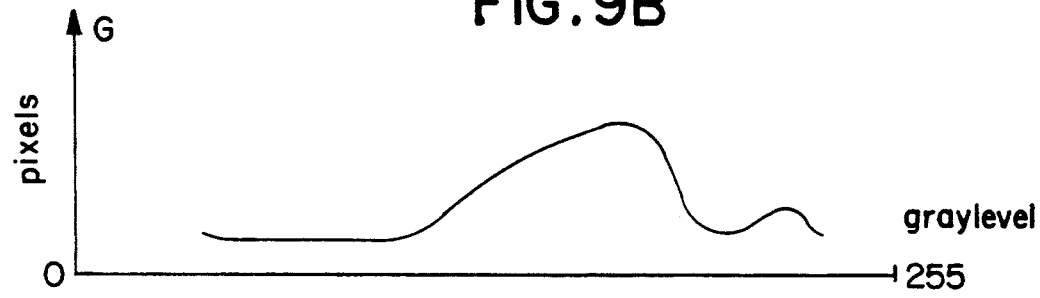
Figure 9C:
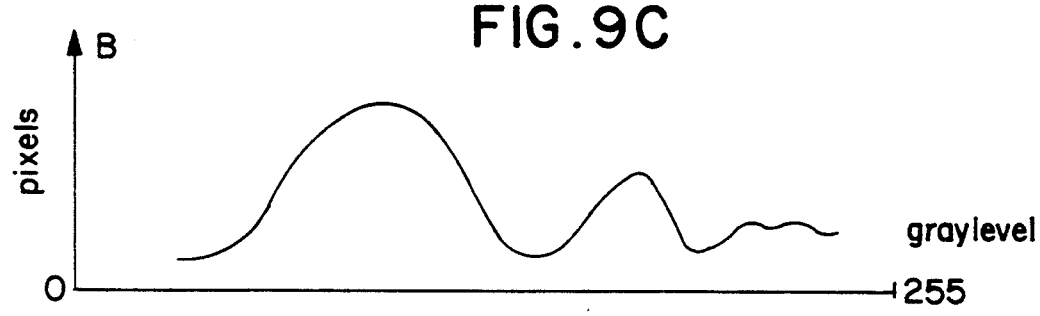
Figure 9D:
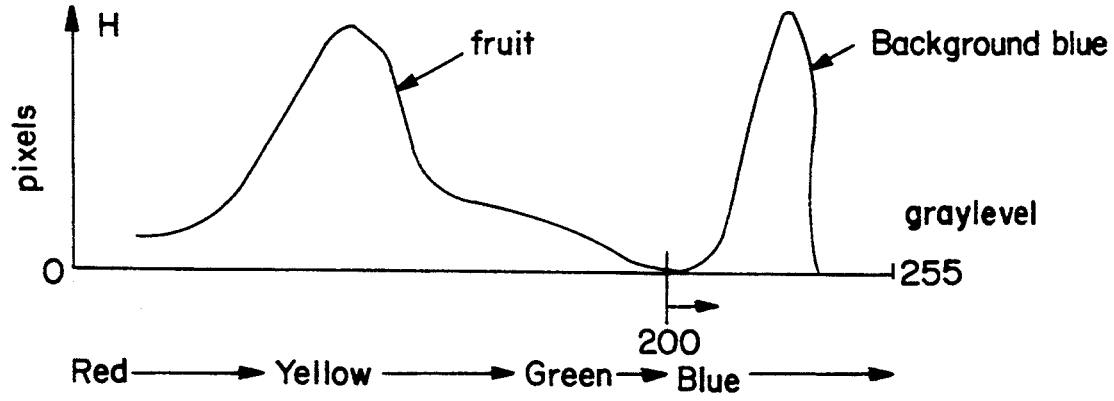
Figure 10:
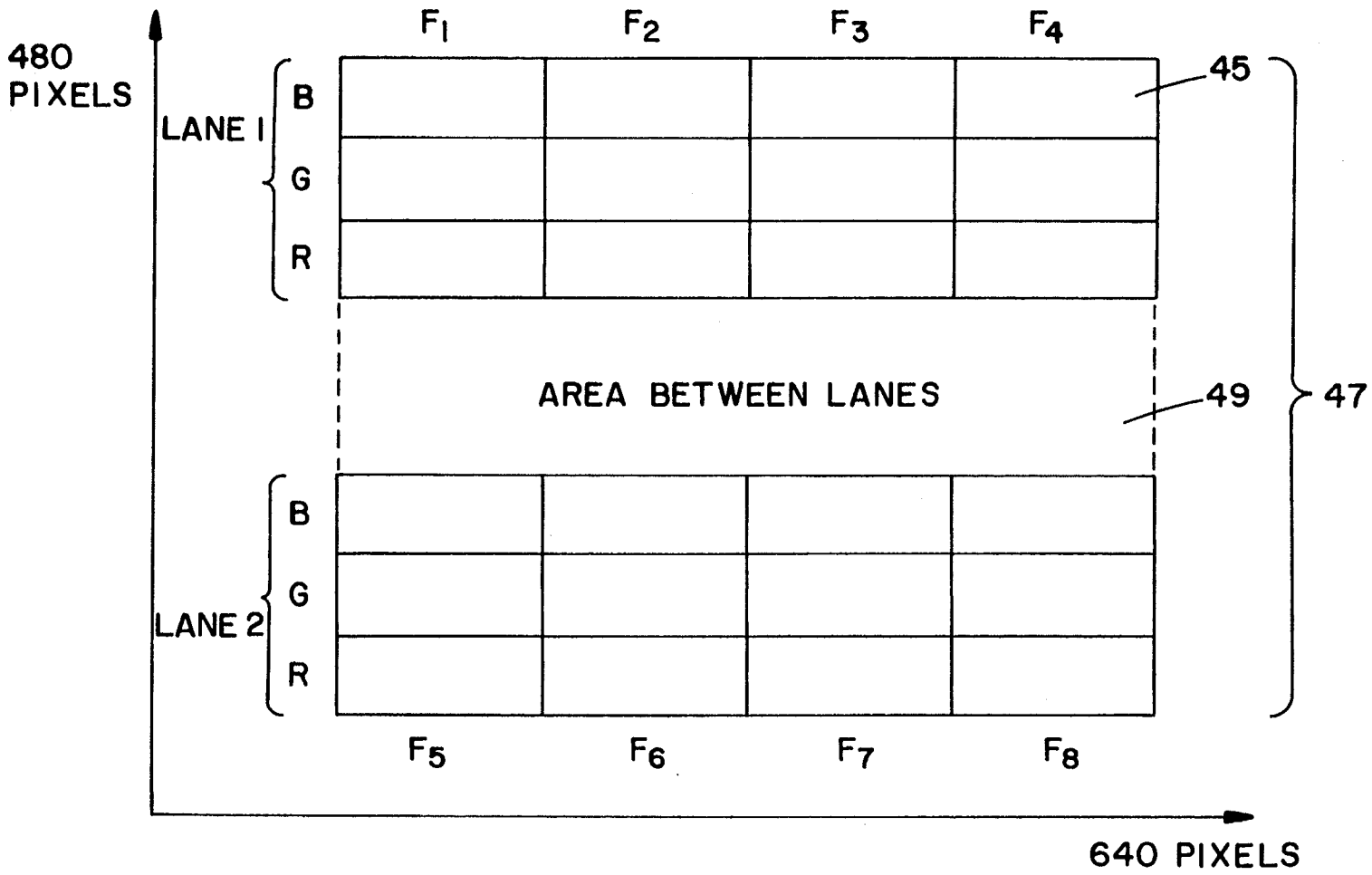

FIGS. *7a* and *7b* illustrate the axes in the RGB plane and HSI transform, respectively;

FIG. *7c* illustrates the relationship between the RGB and HSI representations;

FIG. 8 is a flow diagram showing the steps in performing a color sorting operation;

FIGS. *9a–9d* illustrate levels of RGB and hue, respectively, on a continuous spectrum;

FIG. 10 illustrates a possible arrangement of pixels.

DETAILED DESCRIPTION OF THE PREFERRED EMBODIMENTS

Figure 1:
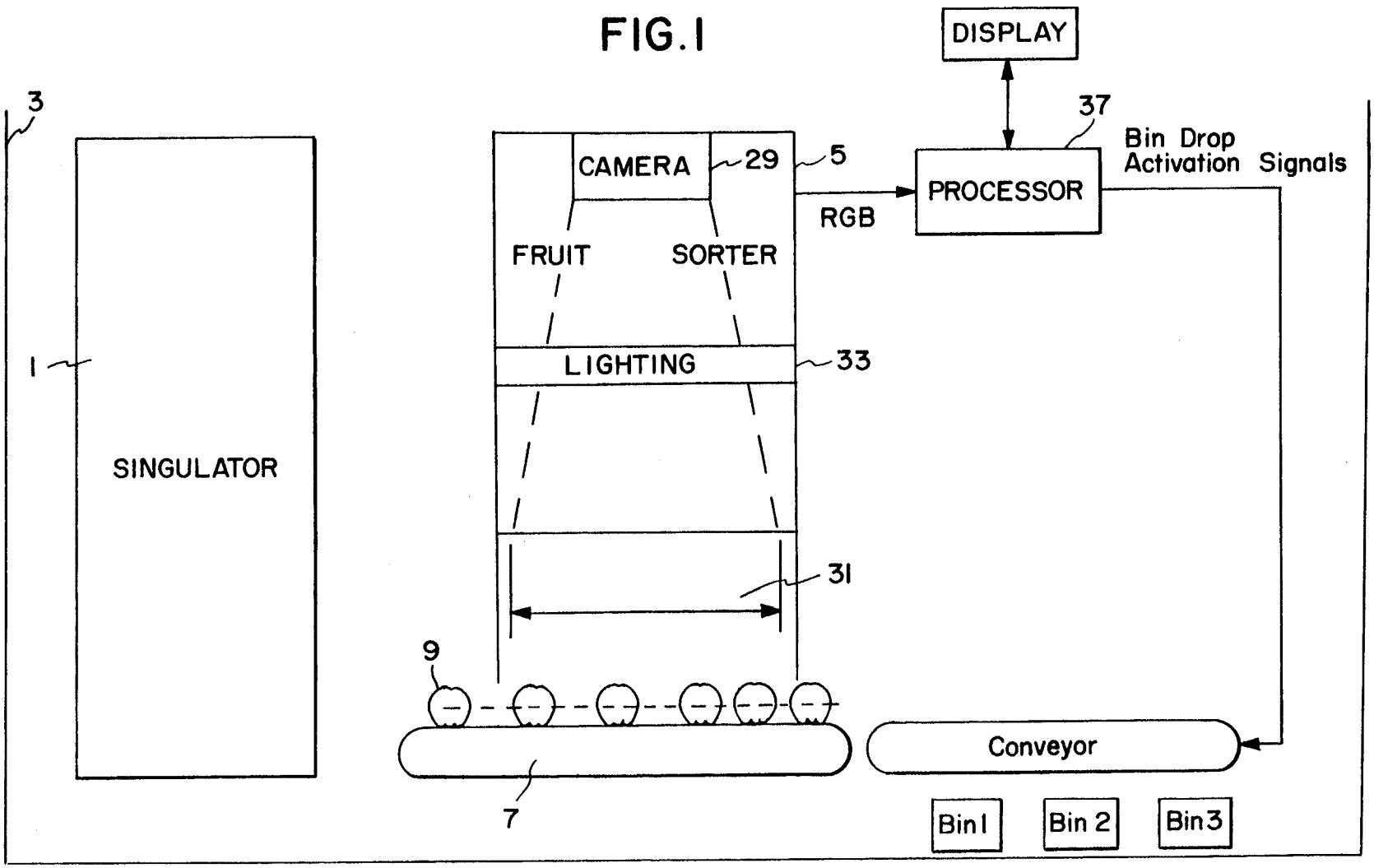
FIG. 1 is a block diagram of a fruit sorting system employing the color sorter of the invention.

As illustrated in FIG. 1, a color sorting apparatus receives lanes of objects in single file, for example fruit, from a singulation section 1 of a fruit sorting device 3. The color sorting apparatus 5 determines a hue value for each object or piece of fruit received and sorts the objects according to the hue value. The fruit or other objects to be sorted are rotated through 360 degrees so that a complete view of all sides of the object can be obtained. One way of rotating fruit or other objects is to employ an independently adjustable speed belt 7 that contacts wheels 9 on which the fruit travels in the color sorting apparatus 5. The belt drives the wheels at a rate to cause a complete, progressive rotation of each fruit item contacting the wheels as it passes through the color sorting section. A composite hue value is determined for each individual item after the hue value has been obtained for each of a plurality of hues, typically four views. The composite hue value is compared to a reference on a continuous spectrum, e.g. from red to green, on which different hue values represent different grades for sorting purposes.

The color sorting apparatus 5 has fluorescent lighting 33 which can be selected to emit selected wavelengths known to enhance color sorting of particular objects. The fluorescent lighting is positioned to illuminate the objects to be sorted. A red-green--blue camera 29 is positioned to obtain images of the objects to be sorted. The camera produces red, green and blue signals for each view of each object imaged. A processor 37 receives the red, green and blue signals from the camera. The processor has a color transformer to execute a transform on the red, green and blue signals and arrive at a hue value on a continuous scale of hue values for hues known to exist in the particular fruit. Thus, for apples, a continuous scale of red to green hues would typically be employed.

Figure 2:
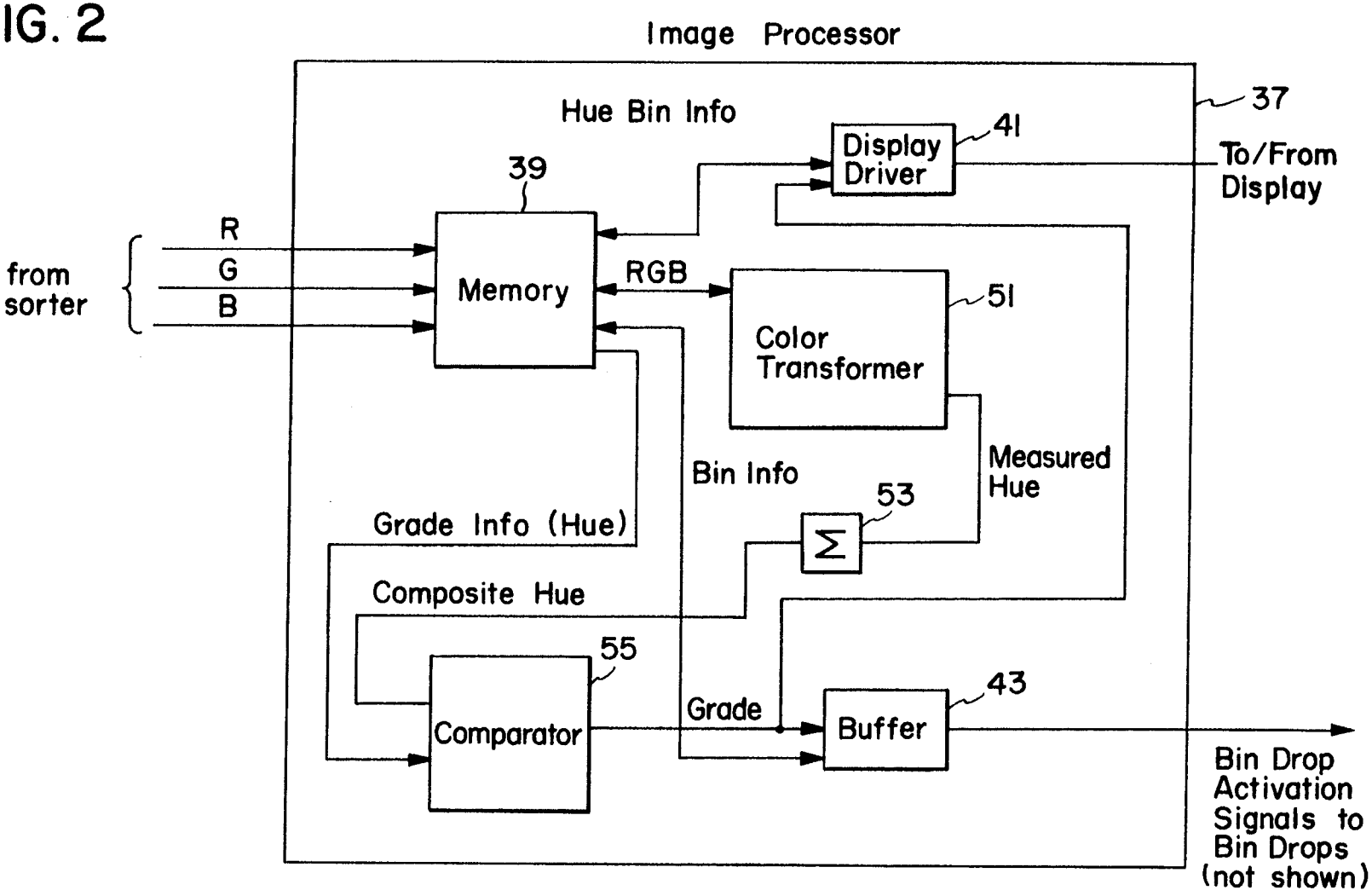
FIG. 2 is a block diagram of an image processor according to the invention.

Memory 39 in FIG. 2 stores a programmed grading scale of hue values. A comparator 55 receives hue signals representing hue values for each object from the color transformer and compares the hue values to the hue values stored in the grading scale, thereby classifying an object into a grade on the scale. It should be noted that the color transformer and comparator can be implemented in hardware or software or any combination thereof, as convenient for the application. In addition, it would be possible to collect and store red, green and blue signals for each of the views, develop a composite red, green and blue signal for the items to be sorted, and command the color transformer to execute the transform on the composite red, green and blue signals to arrive at a hue value.

In addition, the system can easily be programmed such that the hue value for each view can be further used to compare each view hue value to user-specified grades or categories to further separate objects in more detail. Moreover, the individual view pixels in a certain hue range, for example, the red range, can be summed and compared to the total number of counted pixels to obtain a percentage of a certain hue range. For example, if an object is 50% red and 50% green, 50% of the total pixels will be counted as red. Thus, the system can determine that 50% of the object is red. This percentage value can be compared to grade or hue percentage which is specified by the user to further separate the objects.

Figure 4:
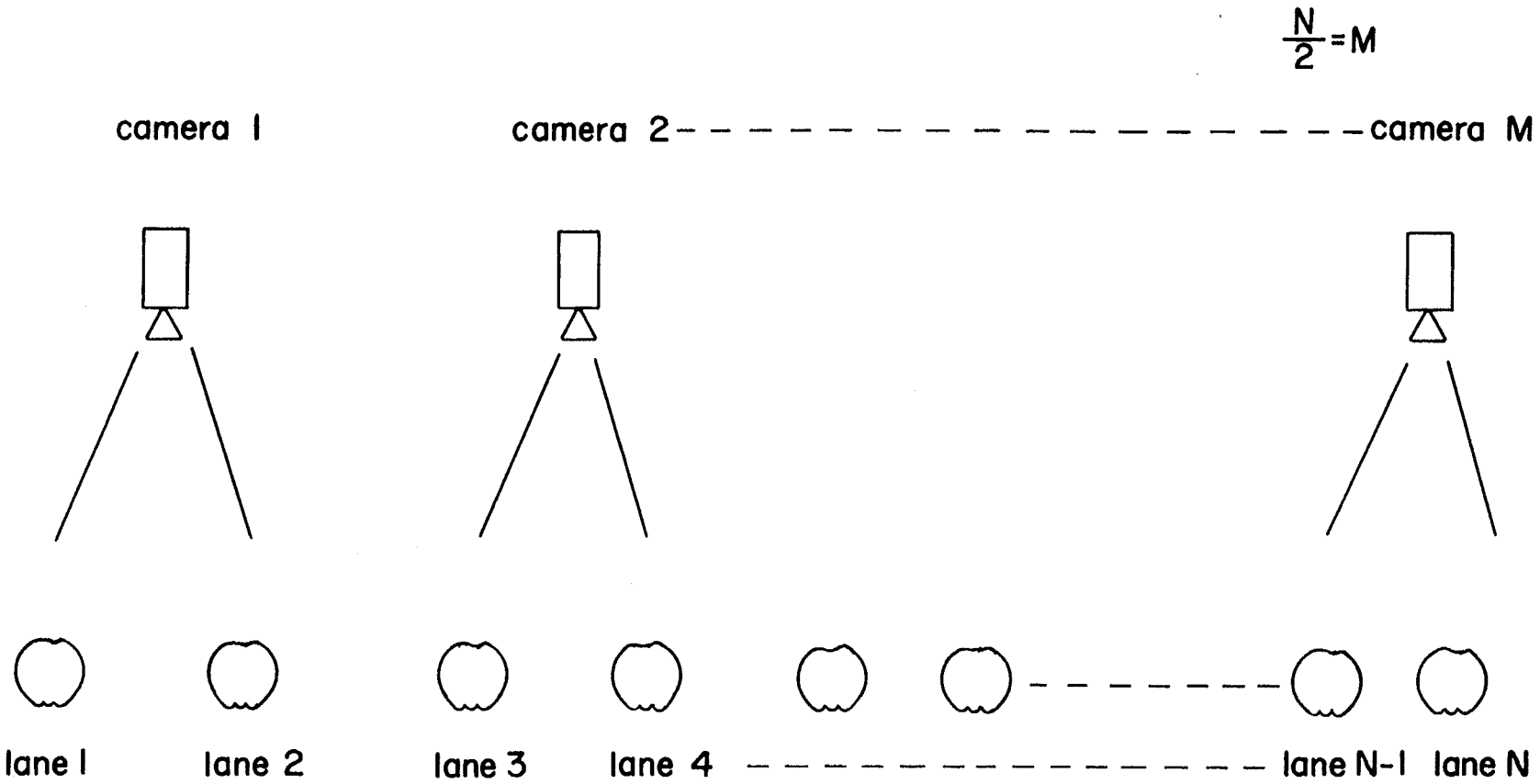
FIG. 4 illustrates cameras, each covering two lanes of fruit.
Figure 5:
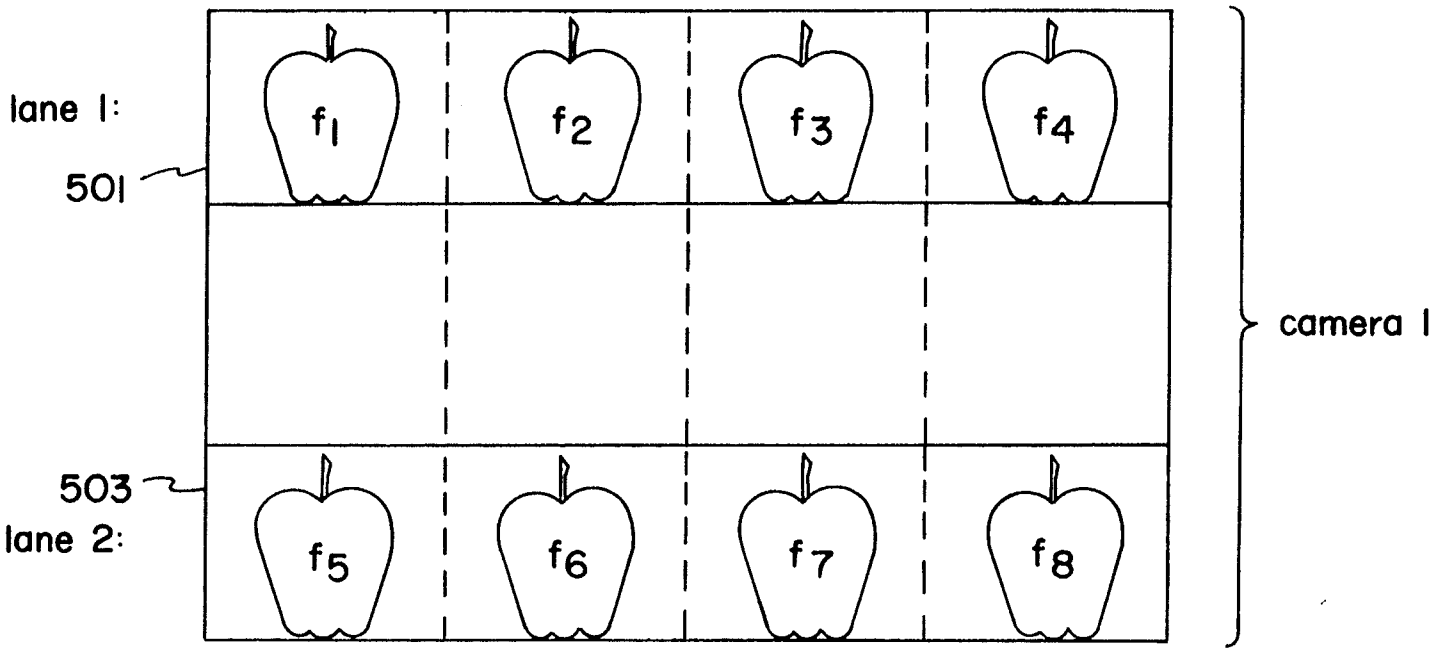
FIG. 5 illustrates a typical two lane image obtained by the invention.

In a preferred embodiment, the camera is synchronously activated to obtain images of four pieces of fruit in each of two lanes simultaneously. FIG. 5 illustrates the image seen by a camera 29 having a field of view that covers two lanes 501, 503. FIG. 4 illustrates a plurality of M lanes covered by N cameras, where $M=N/2$. Thus, 16 lanes of fruit would be covered by 8 cameras, each camera having a field of view of two lanes. Those of ordinary skill will recognize that this is a limitation of the camera equipment and not the invention and that coverage of any number of lanes by any number of cameras having the needed capability is within the scope of the claimed invention.

Figure 6:
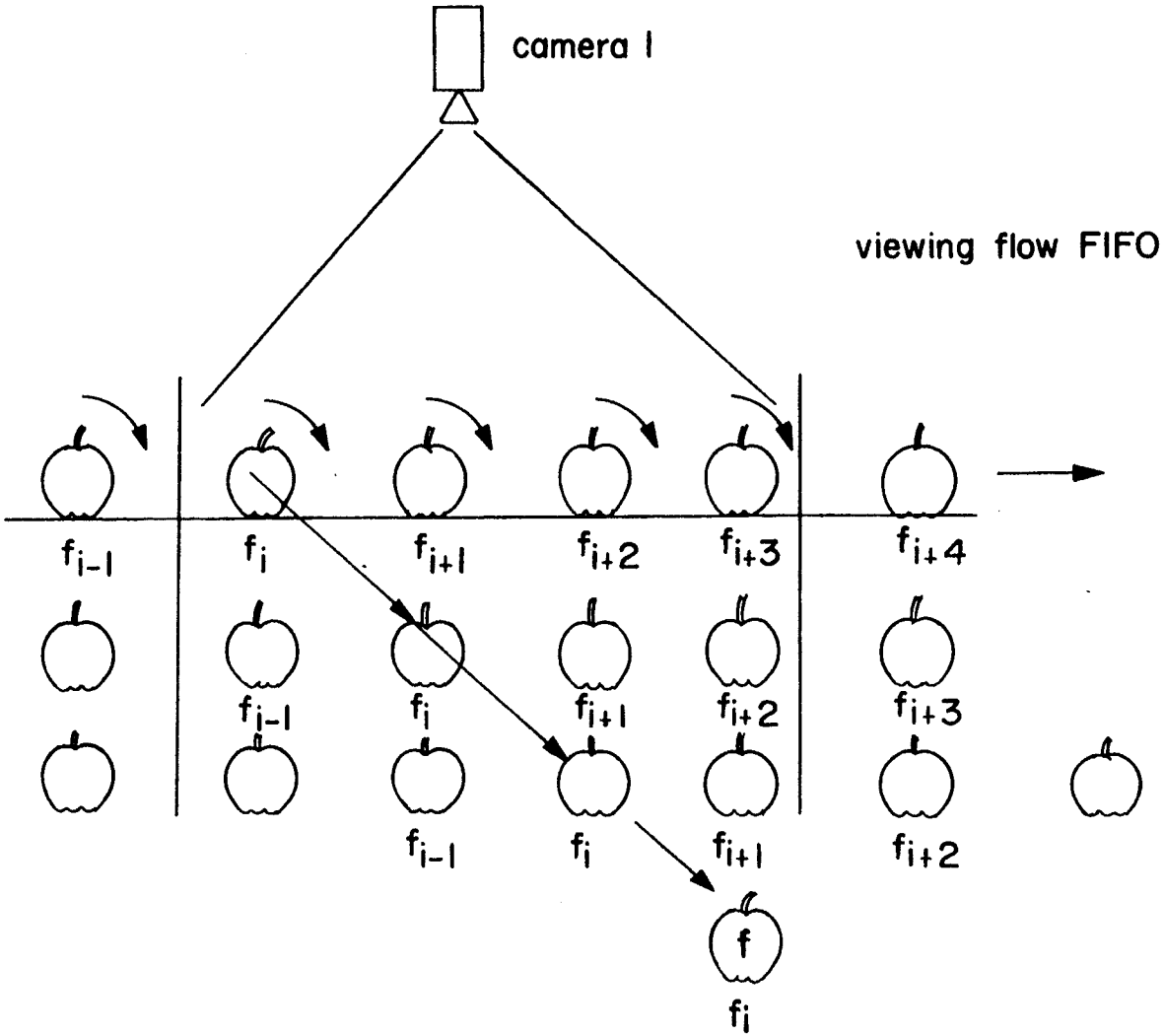
FIG. 6 illustrates the progress of a piece of fruit through the sorter.
Figure 7A:
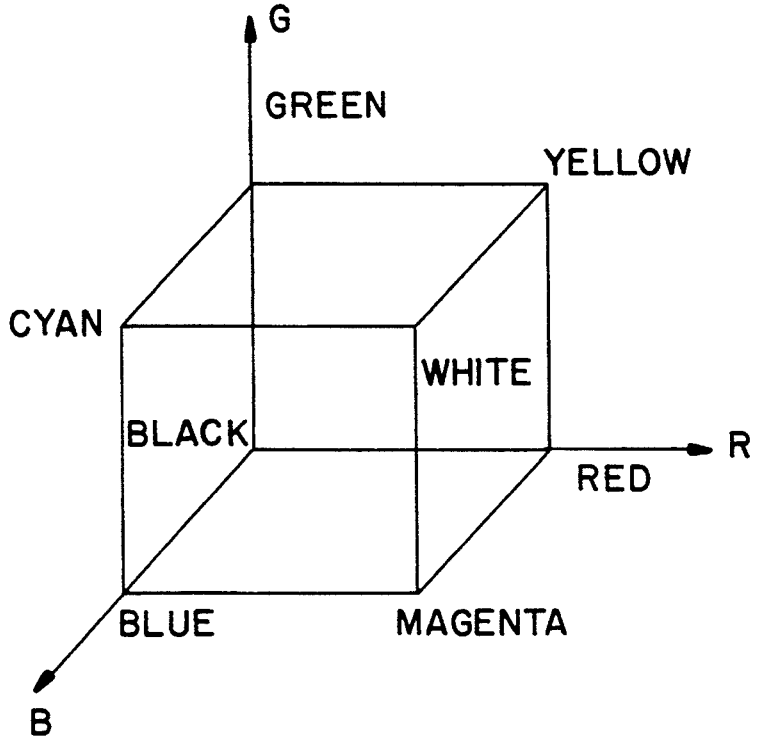
Figure 7B:
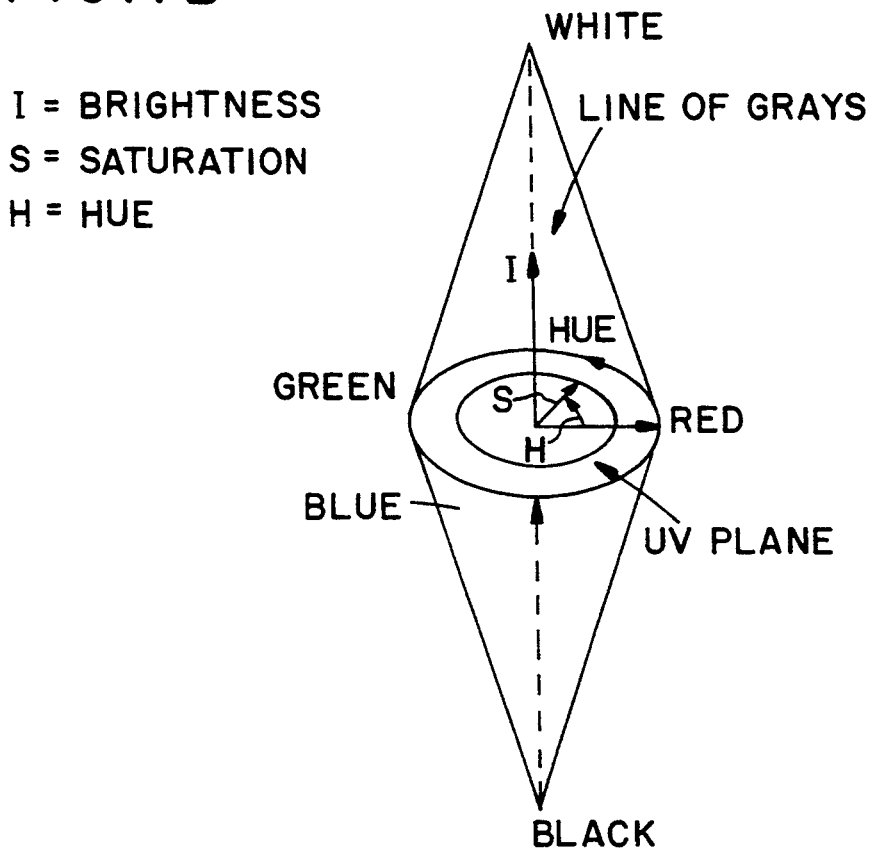
Figure 7C:
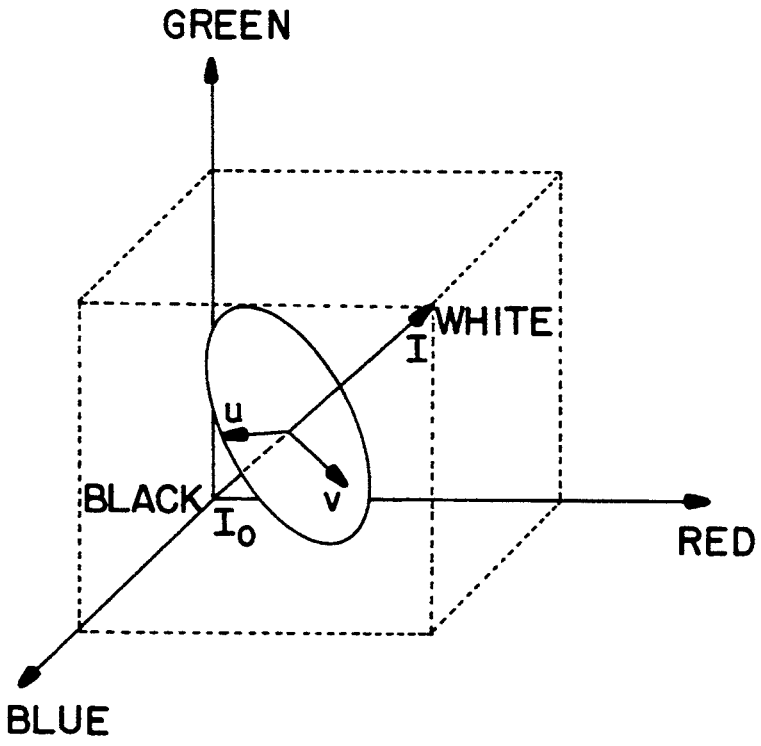

FIG. 6 illustrates the progress of fruit as it rotates through four positions in the sorter. FIG. 6 represents the four positions of a piece of fruit $f_i$ in the four time instants from $t_0$ to $t_3$. Thus, four views of each piece of fruit are obtained. Synchronous operation allows the color transformer to route the red, green and blue signals and to correlate calculated hue values with individual pieces of fruit. Synchronous operation can be achieved by an event triggering scheme. In this approach any known event, such as the passage of a piece of fruit or other object past a reference point can be used to determine when four pieces of fruit are in the field of view of the camera.

Within sorting apparatus 5 are located lighting elements 33. These are typically fluorescent lighting elements which operate unmodulated between 20 KHz and 27 KHz thus eliminating the effects of 60 Hz line frequencies. Fluorescent lighting provides good illumination of the fruit to be sorted. A plurality of fluorescent lights can be employed with each enhancing a different color of the spectrum, as appropriate to the application. Thus, apples known as Delicious might be exposed to lights which enhance a red spectrum while green apples would be exposed to lights enhancing a different spectrum.

Figure 3:
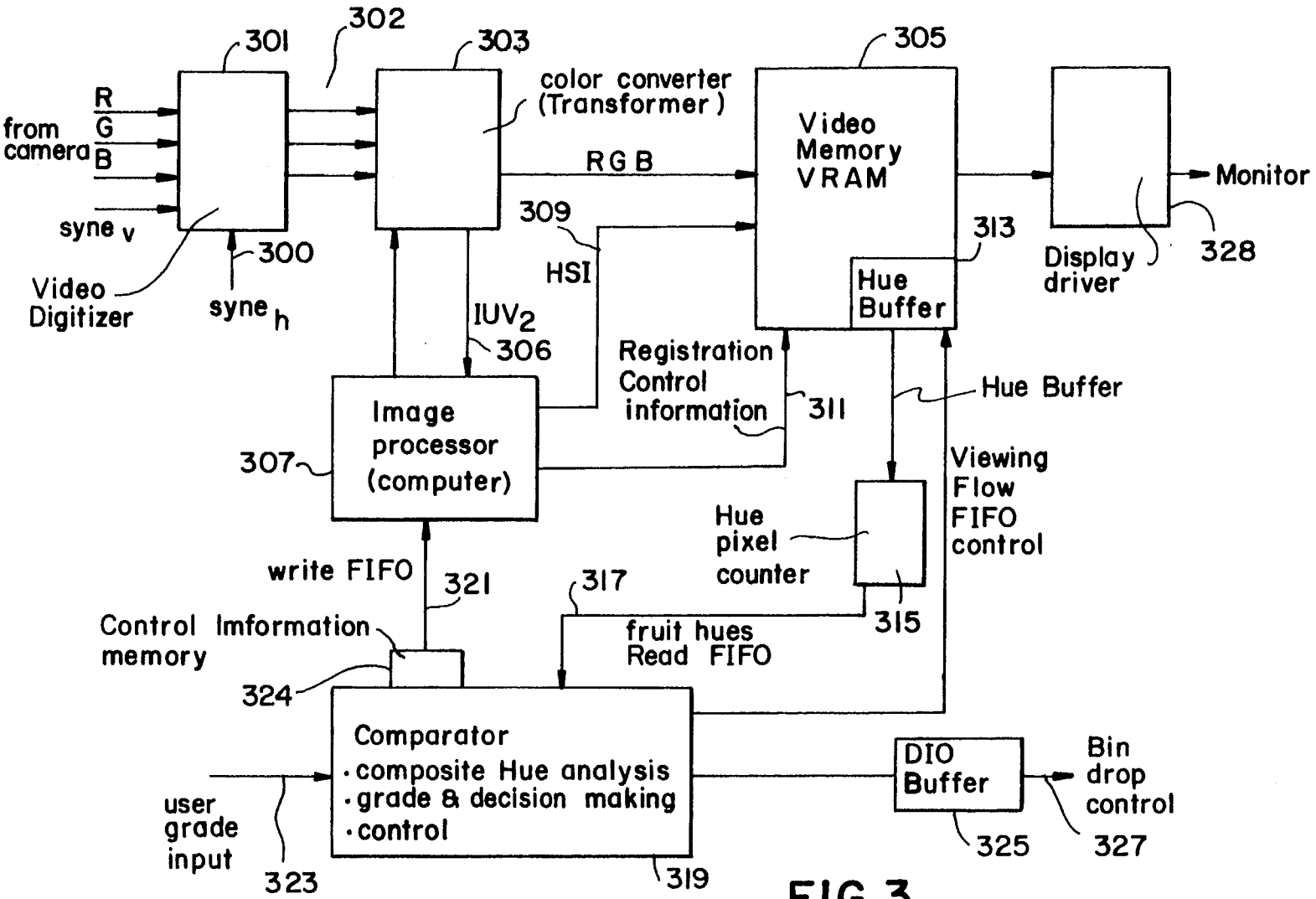
FIG. 3 is a more detailed block diagram of the image processing equipment.

A more detailed block diagram is illustrated in FIG. 3. Responding to a sync signal on signal line 300, a video digitizer receives RGB signals from camera 29 and transmits the digitized signals over signal lines 302 to color converter or transformer 303. The RGB signals are provided from color transformer 303 over signal lines 304 to video random access memory 305. Color transformer 303 transmits intensity, hue and saturation information in the form of signals I, U, V, over signal lines 306 to image processor 307. Image processor 307 transmits signals converted to HSI format to video RAM 305 over signal lines 309. The image processor also provides registration control information to video RAM 305 over signal lines 311 so that the proper signals are associated with the corresponding fruit images. Using the control information, video RAM 305 stores hue data in hue buffer 313 and transmits the hue information to a hue pixel counter 315 at the appropriate time. The hue pixel counter counts the number of pixels of each hue and provides the hue information over signal lines 317 in a first-in first-out (FIFO) format to comparator 319. Comparator 319 communicates with image processor 307 over bidirectional signal line 321 to obtain control and other information and to provide the measured and calculated hue data, also in a FIFO format. User grading input data is provided to the comparator over signal lines 323 and stored in a separate memory 324. The comparator 319 performs analysis of a composite hue value obtained from a combination of hue values for each of the sides of the fruit imaged and compares the composite value to the user provided grading criteria. Based on this comparison, the comparator identifies a grade for each piece of fruit and DIO buffer 325 generates the corresponding bin drop signals 327. The output from the comparator can also be provided to the display driver 328 directly or through video RAM 305 for display to the operator.

FIG. 10 illustrates a possible pixel image obtained in a two lane field of view by camera 29. As shown in FIG. 10, an image of approximately 440 pixels by 240 pixels is obtained. Red, green and blue signals are obtained for each piece of fruit $F_1$–$F_8$ in the field of view. Approximately 12,000 pixels can be found in any one section 45 of the matrix 47. A minimum number of pixels in each section 45 of the matrix must be detected to overcome a noise threshold. It should be noted that area 49 between lanes 1 and 2 would be expected to result in no detections above noise, since no fruit is present in this area and the components are colored blue. Numbers of red, green and blue pixels can be stored in memory 39 as digital words using known techniques. Red-green-blue signals are provided to color transformer 51 in image processor 37. Color transformer 51 can be implemented in hardware or software, as convenient. Color transformer 51 executes a color transform. Alternatively, the color transformation can be performed on the RGB signals prior to storage and only the HSI representation stored. As previously discussed, one possible transform was disclosed by Tao et al., as shown in equation 1 herein. As previously discussed, this transformation reduces color evaluation from three image buffers to one single hue buffer. A different transform is employed in the present invention, as shown in Eqn. 2 below.

FIGS. *7a–7c* illustrate the relationship between the RGB representation and the HSI (Hue, Saturation, Intensity) representations in general. As shown in FIG. *7c*, the HSI representation can be mapped on to the RGB plane.

FIGS. *9a–9c* illustrates the number of pixels of red, green, blue in an example measurement provided by camera 29. FIG. *9d* illustrates the transformation to a single hue measurement from the red, green, blue representation in accordance with the following equations:

$$H_1 = tan^{-1}\{(R-2G)/(3B-R-G)\}\times 255/360 \qquad \text{(Eqn. 2)}$$

$$H_2 = tan^{-1}\{(2R-2G)/(6B-2R-G)\}\times 255/360$$

These equations are defined to enhance the color-spectrum range needed to obtain the optimum color discrimation for the particular objections being sorted. The equations are also defined to match the spectrum of lighting being used by the system. In the illustrated exemplary equations set forth above, the equation H1 is used to enhance the red range on red delicious apples and H2 is used to enhance the yellow-green range on golden delicious apples. The normalization factor (255/360) is based upon an 8 bit storage and will vary with the bit size of the storage.

As shown in FIG. *9d*, a continuous spectrum is obtained from red to yellow to green to blue. Blue is selected as a background color for fruit processing, since no known fruits of interest are predominately blue. Therefore, in processing, blue is simply filtered out. The fruit is then evaluated based on the spectrum as shown in the red, yellow and green portions of the spectrum in FIG. *9d*.

A fruit has approximately 12,000 or more pixel hues on each side depending on the sizes of the objects being sorted. After applying equation 2 and determining the predominant or individual hue values for each of the for example, four images of each object to be sorted, the appropriate measured hues are summed or averaged in summer 53 and a composite hue value is provided to comparator 55. An individual hue value for each view and a hue range percentage for the multiple views can be calculated. These values are used as additional criteria for which to separate objects through comparator 55.

Since a single composite hue value is available, it is possible for an operator to program into memory 39,or preferably memory 324, grades based on a continuous spectrum of hue. Typically, a fruit, such as an apple, is graded on its red color along with variations of green. Thus, a continuous red to green spectrum is selected and blue is generally filtered out, as previously discussed. Using the grade information from memory, comparator 319 in FIG. 3 (or 55 in FIG. 2) identifies a grade for each individual piece of fruit. This grade information can be provided to display driver 328 in FIG. 3 (or 41 in FIG. 2), if desired, and to buffer 325 (or 43 in FIG. 2) which provides bin drop activation signals causing a second conveyor to drop the fruit into the correct bin. Buffer 325 receives bin information from memory 321, while buffer 43 is shown receiving the bin information from memory 39. As previously discussed, bin drop activation signals can be generated in other known ways.

As fruit or other objects exit the color sorting apparatus, they are transferred to a conveyor. In response to the bin drop activation signals, the objects conveyed are deposited in the proper collection bins.

FIG. 8 is a flow diagram illustrating the preferred method of the invention. At step 801 an image is acquired by camera 29 in response to a synchronization signal. RGB signals are then transmitted to the color transformer 303 where, in step 803 the transform to HSI representation is performed, using equation 2. At step 805 the image is allocated to memory. As previously noted, at any one time four pieces of fruit are in the field of view of camera 29 in each lane. In step 807, for fruit, i, in lane, j, the features are extracted. Registration of the fruits images and composite hue buffering for the fruits needed to obtain a composite hue value for each piece of fruit takes place in step 811. In step 809, summing of the pixels is performed to obtain the composite hue values.

At step 813 it is determined if a fruit was detected or if the cup carrying the fruit was empty. If the cup was empty the remaining steps are skipped and the system waits for another image acquisition trigger signal. If an object was detected, based on the number of pixels measured, in step 815 a composite hue and fruit feature analysis is performed preliminary to grading the fruit to establish the characteristics of the fruit that will be compared with user grading criteria. In step 817, the user programmed grading information is compared with the results of the hue and feature analysis in step 817 and a grading decision is made based on the results of the comparison. Grade assignment is made in step 819 and the output signal delayed so that in step 821 Bin output signals can be generated to control dropping of the fruit into the correct collection bins via drop control signals.

While specific embodiments of the invention have been described and illustrated, it will be clear that variations in the details of the embodiments specifically illustrated and described may be made without departing from the true spirit and scope of the invention as defined in the appended claims.

What is claimed is:

1. An apparatus for sorting objects by color comprising:

a singulation section;

a color sorting section having wheels receiving objects from said singulation section, said color sorting section having means for determining a hue value of each object received and for sorting said received objects according to said hue value, said hue value being a quantized measure extracted from a transformation to provide a predetermined continuous range of hue values in said object.

2. The apparatus recited in claim 1 wherein said sorting means comprises:

an independently adjustable speed belt contacting said wheels to rotate said wheels in said color sorting section of said apparatus at a rate causing a complete, progressive rotation of an object contacting said wheels when passing through said sorting section; and means for determining a plurality of hue values for each said object as said object completes a complete rotation and for determining a composite hue value for said object.

3. The apparatus recited in claim 1 wherein said sorting means comprises means for storing a color reference, means for comparing said hue value to said reference and means for classifying an object according to colors defined by said reference.

4. The apparatus recited in claim 1 wherein said color sorting section comprises:

fluorescent lighting positioned to illuminate objects to be sorted;

a red-green-blue camera positioned to obtain images of objects to be sorted and producing red, green and blue signals for objects imaged;

a processor arranged to receive said red, green and blue signals from said camera, said processor having a color transformer to execute a transform on said red, green and blue signals to arrive at a hue value on a continuous scale of hue values between red and green hues;

a memory for storing a programmed grading scale of hue values; and a comparator arranged to receive hue signals representing said hue values for each object from said color transformer and to compare said hue values to hue values in said grading scale, thereby classifying a said object into a grade on said scale.

5. The apparatus recited in claim 4 wherein said sorting section further comprises:

an independently adjustable speed belt contacting said wheels to drive said wheels in said color sorting section of said apparatus at a rate causing a complete, progressive rotation of an object contacting said wheels when passing through said sorting section; and means for determining a plurality of hue values for each said object as said object completes a complete rotation and for determining a composite hue value for said object.

6. The apparatus recited in claim 5 wherein each said red-green-blue camera obtains four images of a said object as said object progresses through a rotation.

7. An apparatus for sorting objects by color comprising:

fluorescent lighting positioned to illuminate objects to be sorted;

a red-green-blue camera positioned to obtain images of objects to be sorted and producing red green and blue signals for objects imaged;

a processor arranged to receive said red, green and blue signals from said camera, said processor having a color transformer to execute a transform on said red, green and blue signals to arrive at a hue value on a continuous scale of hue values between red and green hues;

a memory for storing a programmed grading scale of hue values; and a comparator arranged to receive hue signals representing said hue values for each object from said color transformer and to compare said hue values to hue values in said grading scale, thereby classifying a said object into a grade on said scale.

8. The apparatus recited in claim 7 comprising:

an object rotator synchronously connected to said camera, to progressively rotate each said object and activate said camera to obtain images of a plurality of surfaces of each said object; and a memory for storing a hue value for each surface of a said object as said object progresses through a complete rotation, said transformer having means for determining a composite hue value for said object.

* * * * *